US008282410B2

(12) United States Patent
Siebens et al.

(10) Patent No.: US 8,282,410 B2
(45) Date of Patent: Oct. 9, 2012

(54) ADAPTOR ASSEMBLY FOR ELECTRICAL CONNECTOR

(75) Inventors: Larry N. Siebens, Ashbury, NJ (US); Alan D. Borgstrom, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 1 day.

(21) Appl. No.: 12/900,576

(22) Filed: Oct. 8, 2010

(65) Prior Publication Data

US 2011/0092088 A1 Apr. 21, 2011

Related U.S. Application Data

(60) Provisional application No. 61/253,134, filed on Oct. 20, 2009.

(51) Int. Cl.
*H01R 13/62* (2006.01)

(52) U.S. Cl. ..... 439/362; 439/372

(58) Field of Classification Search ..... 439/333, 439/185, 372, 921; 174/152 R
See application file for complete search history.

(56) References Cited

U.S. PATENT DOCUMENTS

| | | | | |
|---|---|---|---|---|
| 3,401,370 | A * | 9/1968 | Weinfurt et al. | 439/363 |
| 3,512,118 | A * | 5/1970 | Leonard | 439/281 |
| 3,513,425 | A | 5/1970 | Arndt | |
| 3,980,374 | A | 9/1976 | Fallot | |
| 4,203,641 | A * | 5/1980 | Siebens | 439/339 |
| 4,865,559 | A | 9/1989 | Clabburn | |
| 4,891,016 | A * | 1/1990 | Luzzi et al. | 439/183 |
| 6,042,407 | A | 3/2000 | Scull et al. | |
| 6,332,785 | B1 | 12/2001 | Muench, Jr. et al. | |
| 6,364,216 | B1 | 4/2002 | Martin | |
| 7,278,889 | B2 | 10/2007 | Muench et al. | |
| 7,491,075 | B2 | 2/2009 | Hughes et al. | |

* cited by examiner

*Primary Examiner* — Phuong Dinh
(74) *Attorney, Agent, or Firm* — Snyder, Clark, Lesch & Chung, LLP

(57) ABSTRACT

A deadbreak-to-loadbreak adapter assembly may include a deadbreak-to-loadbreak bushing having a first end and a second end, and an annular shoulder portion located between the first end and the second end. The first end may include a loadbreak interface for connecting to a loadbreak device and the second end may include a deadbreak interface for connecting to a deadbreak bushing. A bailing element may be provided for securing the deadbreak-to-loadbreak adapter bushing to a housing in which the deadbreak bushing is installed via a securing force applied to the shoulder portion of the deadbreak-to-loadbreak adapter bushing.

19 Claims, 3 Drawing Sheets

ADAPTOR ASSEMBLY FOR ELECTRICAL CONNECTOR

CROSS-REFERENCE TO RELATED APPLICATION

This application claims priority under 35. U.S.C. §119, based on U.S. Provisional Patent Application No. 61/253,134 filed Oct. 20, 2009, the disclosure of which is hereby incorporated by reference herein.

BACKGROUND OF THE INVENTION

The present invention relates to electrical cable connectors, such as loadbreak connectors and deadbreak connectors.

Deadbreak cable connectors used in conjunction with 15, 25, and 35 Kilovolt (kV) switchgear generally include a power cable elbow connector having one end adapted for receiving a power cable and another end adapted for receiving a deadbreak bushing. The end adapted for receiving the bushing insert generally includes an elbow cuff for providing an interference fit with a molded flange on the bushing. This interference fit between the elbow cuff and the bushing insert provides a moisture and dust seal therebetween. Deadbreak elbows typically comprise a conductor surrounded by a semiconducting layer and an insulating layer, all encased in a semiconductive outer shield.

To service or replace a deadbreak connector, power must be completely disconnected from the connector. In other words, the connector must be "dead" prior to introducing a "break" in the circuit by removing the connector or otherwise opening the ground associated with the device. If power is not disconnected, significant risk of shock or spark may occur. In some instances, for power to be disconnected from a deadbreak connector, an entire transformer must be powered off or otherwise disrupted, causing a disruption in any power equipment connected to the transformer.

Unlike deadbreak connectors, loadbreak connectors may be connected and disconnected without requiring a complete absence of underlying load. In other words, the connector may be under a "load" when introducing the "break." Switchover from deadbreak connectors to loadbreak connectors, while otherwise advantageous, is a costly endeavor, typically requiring replacement of a significant portion of associated switchgear.

DETAILED DESCRIPTION OF THE PREFERRED EMBODIMENTS

The following detailed description refers to the accompanying drawings. The same reference numbers in different drawings may identify the same or similar elements.

Figure 1:
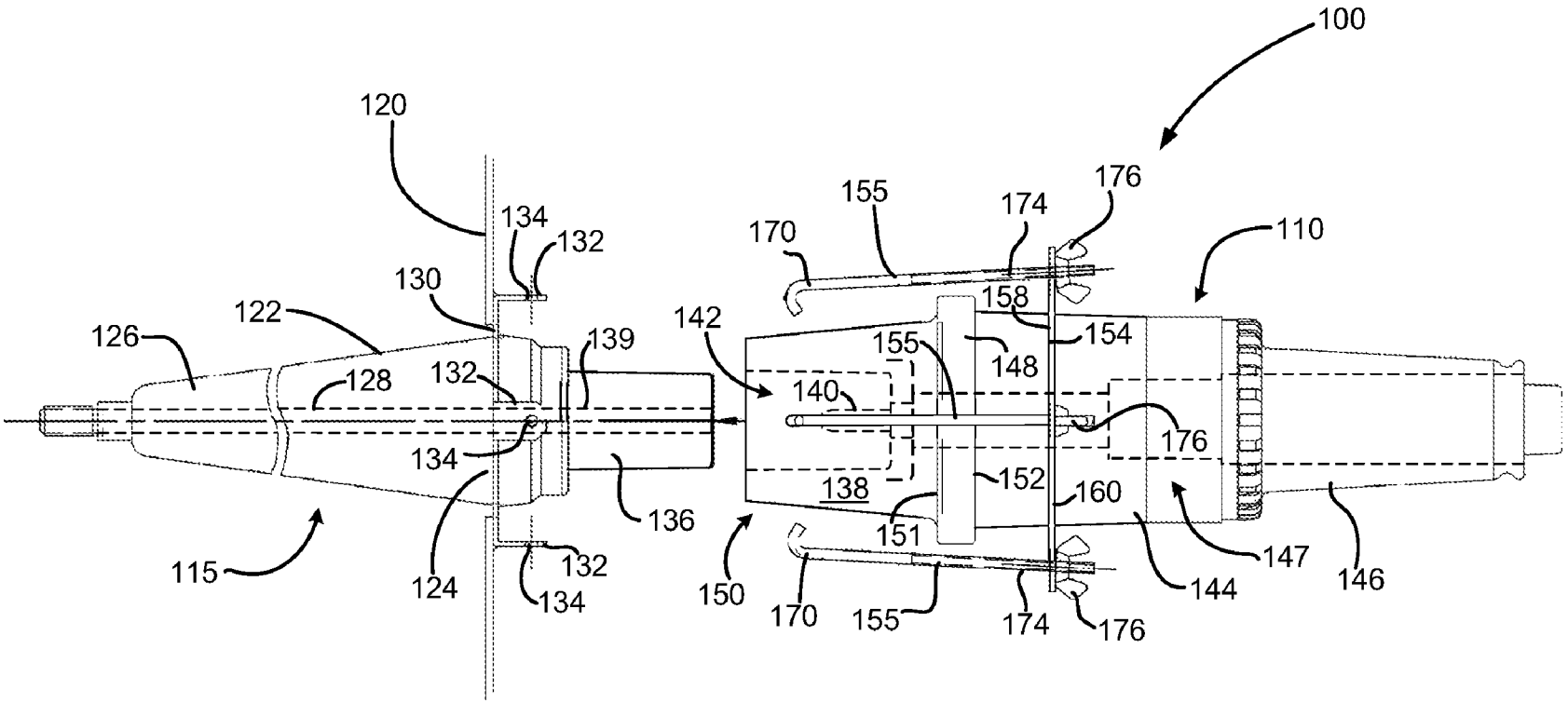
FIG. 1 is a side elevational view of a deadbreak-to-loadbreak adapter illustrated in an unassembled configuration consistent with implementations described herein.
Figure 2B:
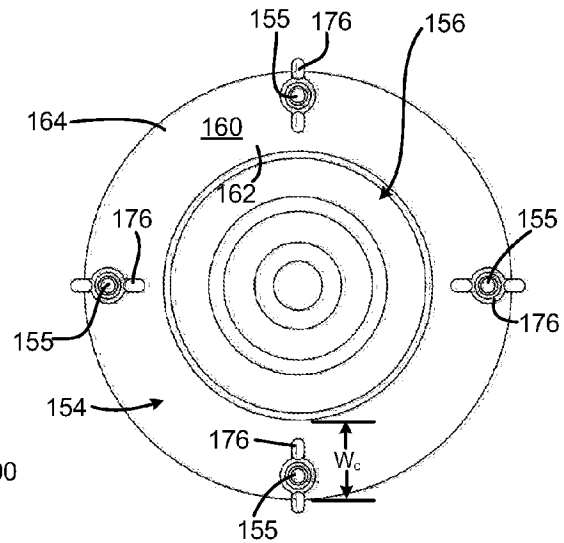
FIG. 2B is an end view of the deadbreak-to-loadbreak adapter of FIG. 1.
Figure 2A:
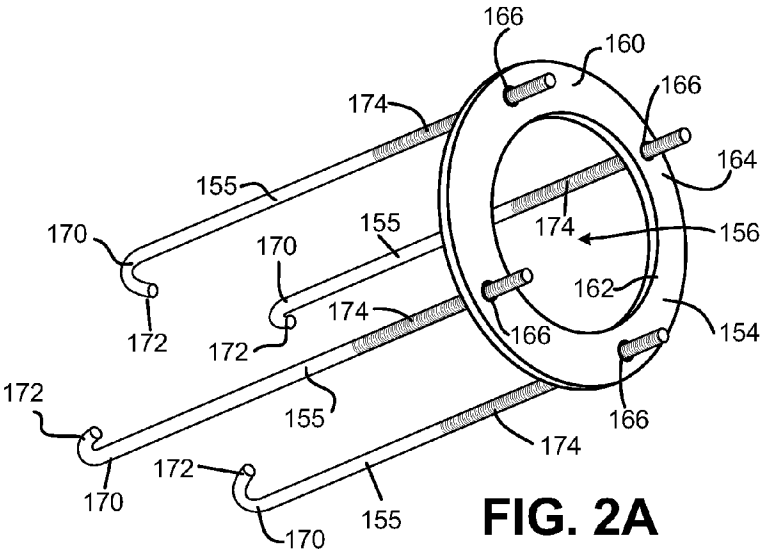
FIG. 2A is an isometric illustration of a bailing element configuration for use with the deadbreak-to-loadbreak adapter of FIG. 1.
Figure 2C:
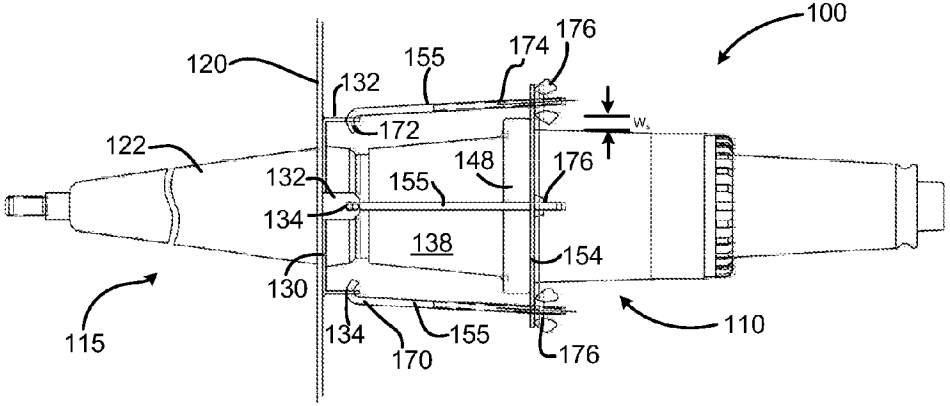
FIG. 2C is a side elevational view of the deadbreak-to-loadbreak adapter of FIG. 1 in an assembled configuration.

FIG. 1 is a side elevational view of a deadbreak-to-loadbreak adapter 100 illustrated in an unassembled configuration consistent with implementations described herein. FIG. 2A is an isometric illustration of a bailing element configuration for use with deadbreak-to-loadbreak adapter 100. FIG. 2B is an end view of deadbreak-to-loadbreak adapter 100. FIG. 2C is a side elevational view of deadbreak-to-loadbreak adapter 100 illustrated in an assembled configuration consistent with implementations described herein. The following description is made with respect to FIGS. 1-2C.

As shown in FIG. 1, adapter 100 may be configured to facilitate connection of a deadbreak-to-loadbreak adapter bushing 110 to a legacy deadbreak bushing 115 that is fixedly connected to transformer housing 120.

Legacy deadbreak bushing 115 may include an axially extending, substantially conical body portion 122 having a first end 124 and a second end 126 provided distal from first end 124. Body portion 122 may be configured to include an axially extending central conductor 128 running therein for connecting a cable terminating element, such as an elbow connector, a tee-connector, an insulated cap, etc., from first end 124 and internal transformer switchgear to second end 126.

As illustrated in FIG. 1, first end 124 of deadbreak bushing 115 may be connected to transformer housing 120 via a conductive mounting ring 130. More specifically, an interior edge of mounting ring 130 may be embedded within an outer housing of deadbreak bushing 115 (not shown). A width or outside diameter of mounting ring 130 may be sufficient to extend beyond an outside diameter of an opening in transformer housing 120 for receiving deadbreak bushing 115. Mounting ring 130 may be permanently affixed to transformer housing 120 via, e.g., welding or a conductive epoxy material. Mounting ring 130 may also include a plurality of bailing tabs 132 projecting perpendicularly therefrom. For example, mounting ring 130 may include four bailing tabs 132 spaced uniformly about an outer diameter of mounting ring 130. Each bailing tab 132 may include an opening 134 therein. Bailing tabs 132 may form a bailing structure for allowing devices attached to deadbreak bushing 115 to be securely fastened to transformer housing 120.

In some implementations, exterior surfaces of switchgear elements, such as transformers, connectors, bushings, etc. may provide ground paths or connections for associated devices during operation. To ensure that no break is provided in this ground path during operation that could result in arcing or flashover occurrences, outer or exposed surfaces of deadbreak bushing 115 and any connected devices, such as elbow connectors, tee-connectors, splices, caps, etc., may also be formed of conductive or semiconductive materials, thereby providing unbroken ground paths. In one implementation, the outer exposed surface of deadbreak bushing 115 may be formed of conductive ethylene-propylene-diene monomer (EPDM) rubber or acrylonitrile butadiene rubber (NBR). Furthermore, consistent with these principles, mounting ring 130 and bailing tabs 132 may be formed of a conductive or semiconductive material, such as a metal, or an elastomer impregnated with conductive particles.

First end 124 of deadbreak bushing 115 may include a substantially cylindrical portion 136 configured to matingly engage a corresponding portion a deadbreak device, such as an elbow connector (not shown). Consistent with implementations described herein, first end 124 may also be configured to matingly receive a deadbreak end 138 of deadbreak-to-loadbreak bushing 110, as will be described in additional detail below.

Central conductor 128 may, in an area proximal to cylindrical portion 136 of first end 124, include a substantially tubular conductive region 139 (shown in dashed lines) for receiving therein an extending portion of a connected device, such as a conductor or stud extending from a cable termination end, such as an elbow, tee-connector, etc.

As illustrated in FIG. 1, deadbreak-to-loadbreak adapter bushing 110 may be configured to provide an interface between legacy deadbreak bushing 115 and a loadbreak device, such as an elbow connector (shown in FIG. 3), a tee-connector, a splice, an insulated cap, etc. As discussed briefly above, converting a transformer from deadbreak-to-loadbreak is typically a costly and inefficient process, requiring removal of the transformer from a facility, removal of the any deadbreak bushing(s), and installation of loadbreak bushing wells into the transformer for receiving a loadbreak bushing therein.

Consistent with implementations described herein, the structure and devices attached to the transformer may be updated to loadbreak without requiring removal of the transformer or removing the deadbreak bushings installed therein. To enable this, deadbreak-to-loadbreak adapter bushing 110 may be configured to include a generally cylindrical body member 144 having a loadbreak end 146 and deadbreak end 138. In one exemplary implementation, body member 144 may be formed of conductive EPDM rubber. As shown, loadbreak end 146 may be configured to include a loadbreak bushing interface 147, such as an arc confining and extinguishing elements, connection elements for facilitating a connection to an elbow connector, etc. Loadbreak bushing interface 147 may be configured to receive thereon loadbreak devices, such as tee connectors, elbows, etc.

Deadbreak end 138 of deadbreak-to-loadbreak adapter bushing 110 may be configured to include a deadbreak bushing interface 150. For example, deadbreak bushing interface 150 may include a cavity 142 (shown in dashed lines) for receiving substantially cylindrical portion 136 of deadbreak bushing 115 upon connection of deadbreak-to-loadbreak adapter bushing 110 to deadbreak bushing 115. A conductor/stud 140 (shown in dashed lines) may project within cavity 142 toward deadbreak bushing 115. Upon assembly, conductor/stud 140 may be received within substantially tubular conductive region 139 of deadbreak bushing 115, thereby electrically connecting deadbreak-to-loadbreak adapter bushing 110 to deadbreak bushing 115.

Deadbreak-to-loadbreak adapter bushing 110 may include a shoulder region 148 formed between loadbreak end 146 and deadbreak end 138 that forms a substantially cylindrical flange about an intermediate portion of cylindrical body member 144. As illustrated in FIG. 1, an outside diameter of shoulder region 148 may be slightly larger than an outside diameter of body portion 144 in a region proximal to shoulder region 148, thereby forming a forward surface 151 substantially perpendicular to an axial direction of cylindrical body member 144 and a rearward surface 152 opposing forward surface 151. In one exemplary implementation, rearward surface 152 may have an annular width $W_s$ (depicted in FIG. 2C) of approximately 3/16 inches.

Depending on the type of loadbreak equipment being used, different components and configurations may be included within deadbreak-to-loadbreak adapter bushing 110. For example, a 25 kV deadbreak-to-loadbreak adapter bushing 110 may be configured slightly differently than a 15 kV or 35 kV deadbreak-to-loadbreak adapter bushing 110. However, it should be understood that the differences in these configurations do not depart from the spirit and scope of the aspects described herein.

Deadbreak interfaces typically do not include provisions for holding them together, so it is necessary to secure deadbreak-to-loadbreak adapter bushing 110 to deadbreak bushing 115 prior to energizing the connection. To facilitate such securing, an adapter collar 154 may be provided for clampingly securing deadbreak-to-loadbreak adapter bushing 110 to deadbreak bushing 115 via a number of bailing rods 155. As illustrated in FIGS. 1 and 2A, adapter collar 154 may include a substantially ring-like configuration that includes a plate having an aperture 156 extending therethrough and having a forward surface 158 and a rearward surface 160. A diameter of aperture 156 may be sized to be substantially equal to an outside diameter of body portion 144 of deadbreak-to-loadbreak adapter bushing 110 in a region proximal to rearward surface 152 of shoulder region 148, yet smaller than the outside diameter of shoulder region 148.

Based on this configuration, when adapter collar 154 is placed over loadbreak end 146 of deadbreak-to-loadbreak adapter bushing 110, forward surface 158 of adapter collar 154 may abut rearward surface 152 of shoulder portion 148. An annular width $W_c$ of adapter collar 154 may be sized such that an inner portion 162 of adapter collar 154 abuts shoulder portion 148 and a periphery 164 of adapter collar extends beyond the outside diameter of shoulder portion 148. That is, width $W_c$ is larger than width $W_s$. In one exemplary implementation, annular width $W_c$ (depicted in FIG. 2B) may be approximately 13/16 inches.

As illustrated in FIG. 2B, periphery 164 of annular collar 154 may include a plurality of apertures 166 therethrough spaced uniformly about periphery 164. For example, annular collar 154 may include four apertures 166 that correspond to the placement of bailing tabs 132 in mounting ring 130. A plurality of bailing elements 155 may connect adapter collar 154 to bailing tabs 132. For example, four bailing rods 155 may connect to both apertures 166 in adapter collar 154 and openings 134 in bailing tabs 132.

As depicted in FIGS. 1 and 2A, bailing rods 155 may each include a hooked end 170 having a hook 172 thereon and a threaded end 174 distal from hooked end 170. Bailing rods 155 may have any suitable length for facilitating assembly of adapter 100 in the manner described below. During assembly, hooked ends 170 of bailing rods 155 may be initially inserted into openings 134 of bailing tabs 132. Threaded ends 174 may then be inserted into apertures 166 in adapter collar 154 when adapter collar 154 is positioned over deadbreak-to-loadbreak adapter bushing 110. Nuts 176 (e.g., hand tightenable wing-type nuts) may be threaded onto threaded ends 174 of bailing rods 155 and tightened, thereby securing deadbreak-to-loadbreak adapter bushing 110 to deadbreak bushing 115 via a compression force between adapter collar 154 and shoulder portion 148. Although described above in reference to adapter collar 154, in some implementations consistent with aspects described herein, the features of adapter collar 154 may be integral with shoulder portion 148. That is, shoulder portion 148 may include apertures 166 for receiving threaded ends 174 of bailing rods 155.

Although the present description refers to bailing rods 155 having opposing hooked and threaded ends, it should be understood that any suitable bailing element may be used, such as bailing straps or wires, clamps, a hub configuration, etc.

Figure 3:
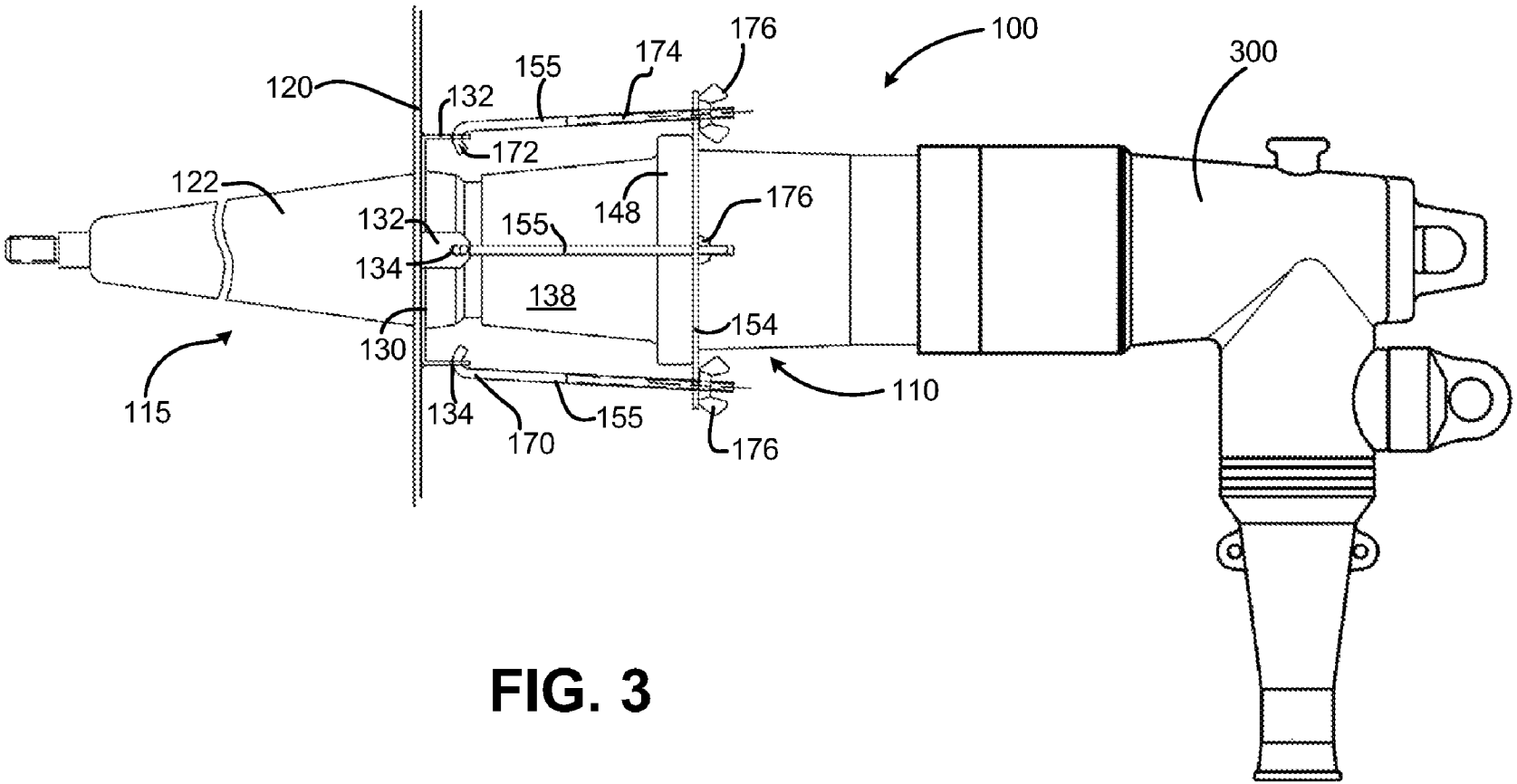
FIG. 3 is side elevational view of the deadbreak-to-loadbreak adapter of FIG. 1 in an installed configuration.

FIG. 3 is a side elevational view of a deadbreak-to-loadbreak adapter 100 illustrated in an assembled configuration, and further connected to a loadbreak elbow 300. As illustrated, deadbreak-to-loadbreak adapter 100 facilitates connection of a loadbreak device to a legacy deadbreak bushing in an effective and low cost manner.

The above-described devices and configurations provide a low cost and effective mechanisms for converting a transformer or other switchgear from deadbreak to loadbreak. More specifically, deadbreak-to-loadbreak adapter bushing 110 may be easily and quickly installed on a legacy deadbreak bushing that is already affixed to the transformer.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for a number of loadbreak devices or families of devices.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A deadbreak-to-loadbreak adapter assembly, comprising:

a deadbreak-to-loadbreak adapter bushing having a first end and a second end, and an annular shoulder portion located between the first end and the second end, wherein the first end comprises a loadbreak interface for connecting to a loadbreak device and the second end comprises a deadbreak interface for connecting to a deadbreak bushing; and bailing means for securing the deadbreak-to-loadbreak adapter bushing to a housing in which the deadbreak bushing is installed via a securing force applied to the shoulder portion of the deadbreak-to-loadbreak adapter bushing.

2. The deadbreak-to-loadbreak adapter assembly of claim 1, wherein the deadbreak-to-loadbreak adapter bushing comprises a 15 kilovolt bushing, a 25 kilovolt bushing, or a 35 kilovolt bushing.

3. The deadbreak-to-loadbreak adapter assembly of claim 1, wherein the loadbreak device comprises a loadbreak elbow, a loadbreak tee connector, or a loadbreak insulating cap.

4. The deadbreak-to-loadbreak adapter assembly of claim 1, wherein the deadbreak interface includes a cavity for receiving a projecting end of the deadbreak bushing.

5. The deadbreak-to-loadbreak adapter assembly of claim 1, wherein the first end, the second end, and the shoulder portion comprise substantially cylindrical configurations, and wherein the shoulder portion projects from the first end to form a rearward surface having an annular width sufficient to receive the bailing means thereon.

6. The deadbreak-to-loadbreak adapter assembly of claim 5, wherein the annular width comprises approximately 3/16 inches.

7. The deadbreak-to-loadbreak adapter assembly of claim 5, wherein the bailing means further comprises:

an adapter collar having a forward surface configured to abut the rearward surface of the shoulder portion; and bailing elements to securely connect the adapter collar to a bailing structure associated with the deadbreak bushing.

8. The deadbreak-to-loadbreak adapter assembly of claim 7, wherein the adapter collar comprises a substantially ring-like configuration having an aperture therethrough for receiving the first end of deadbreak-to-loadbreak adapter bushing.

9. The deadbreak-to-loadbreak adapter assembly of claim 7, wherein the adapter collar includes a number of apertures formed in a periphery thereof, wherein the apertures in the periphery are configured to receive the bailing elements.

10. The deadbreak-to-loadbreak adapter assembly of claim 7, wherein the bailing elements comprise bailing rods, each of the bailing rods having a threaded end and a hooked end, wherein the threaded ends of the bailing rods are received in the apertures in the periphery of the adapter collar, and wherein the hooked ends of the bailing rods are configured to be received in the bailing structure associated with the deadbreak bushing.

11. The deadbreak-to-loadbreak adapter assembly of claim 1, wherein the bailing means further comprises:

a number of apertures formed in a periphery of the shoulder portion; and bailing elements to securely connect the deadbreak-to-loadbreak adapter bushing to a bailing structure associated with the deadbreak bushing via the number of shoulder apertures.

12. A system, comprising:

a transformer housing;

a deadbreak bushing affixed to the transformer housing via a mounting ring, an adapter bushing comprising:

a first end;

a second end distal from the first end; and an annular shoulder portion located between the first end and the second end and extending radially from the first end to form a rearward surface, wherein the first end comprises a loadbreak interface for connecting to a loadbreak device and the second end comprises a deadbreak interface for connecting to a deadbreak bushing; and a bailing device for securing the adapter bushing to the transformer housing.

13. The system of claim 12, wherein the second end of the adapter bushing includes a cavity for receiving a portion of the deadbreak bushing.

14. The system of claim 13, wherein the adapter bushing includes arc confining and extinguishing elements.

15. The system of claim 12, wherein the mounting ring is welded to the transformer housing and wherein the mounting ring includes a number of spaced apart bailing tabs extending therefrom, and wherein the bailing device is configured to secure the adapter bushing to the transformer housing via the bailing tabs.

16. The system of claim 15, wherein the bailing device further comprises:

an adapter collar having a forward surface configured to abut the rearward surface of the shoulder portion; and bailing elements to securely connect the adapter collar to the bailing tabs.

17. The system of claim 12, wherein the adapter bushing comprises a 15 kilovolt bushing, a 25 kilovolt bushing, or a 35 kilovolt bushing.

18. A high voltage deadbreak-to-loadbreak adapter, comprising:

an adapter bushing that includes a deadbreak end and a loadbreak end, wherein the deadbreak end includes a deadbreak interface for receiving a deadbreak bushing therein, and wherein the loadbreak end includes a loadbreak interface for connecting to a loadbreak device; and a bailing device for securing the adapter bushing to a housing in which the deadbreak bushing is installed, wherein the bailing device comprises:

an adapter collar configured to abut a portion of an outer surface of the adapter bushing, wherein the adapter collar includes a number of apertures spaced about a periphery thereof;

a number of bailing rods, each having a threaded end and a hooked end, wherein the threaded end of each bailing rod is configured to extend through a corresponding one of the number of apertures in the adapter collar, wherein the hooked end of each bailing rod is configured to engage the housing in which the deadbreak bushing is installed; and a number of nuts configured to thread on the threaded ends of the number of bailing rods upon insertion through a corresponding one of the number of apertures in the adapter collar, wherein tightening of each of the number of nuts secures the adapter bushing to the housing via the number of bailing rods.

19. The high voltage deadbreak-to-loadbreak adapter of claim 18, wherein the adapter bushing includes an outer surface formed of a semiconductive material.

* * * * *